US009573255B2

(12) United States Patent
Pamatmat

(10) Patent No.: US 9,573,255 B2
(45) Date of Patent: Feb. 21, 2017

(54) BIT HOLDER

(71) Applicant: Timothy Pamatmat, Forestville, CA (US)

(72) Inventor: Timothy Pamatmat, Forestville, CA (US)

( * ) Notice: Subject to any disclaimer, the term of this patent is extended or adjusted under 35 U.S.C. 154(b) by 116 days.

(21) Appl. No.: 13/261,986

(22) PCT Filed: Apr. 11, 2013

(86) PCT No.: PCT/US2013/036153
§ 371 (c)(1),
(2) Date: Nov. 7, 2014

(87) PCT Pub. No.: WO2013/155289
PCT Pub. Date: Oct. 17, 2013

(65) Prior Publication Data

US 2016/0082576 A1 Mar. 24, 2016

Related U.S. Application Data

(60) Provisional application No. 61/686,825, filed on Apr. 11, 2012, provisional application No. 61/687,402, filed on Apr. 23, 2012.

(51) Int. Cl.
*B25B 23/10* (2006.01)
*B25B 23/00* (2006.01)

(52) U.S. Cl.
CPC ..... *B25B 23/10* (2013.01); *B25B 23/0035* (2013.01)

(58) Field of Classification Search
CPC ..... B25B 23/10; B25B 23/0035
See application file for complete search history.

(56) References Cited

U.S. PATENT DOCUMENTS 8,893,591 B2 * 11/2014 DePue ..... H02G 1/00 269/43
2006/0228181 A1 * 10/2006 Kozak ..... B23B 31/005 408/239 R
2015/0000104 A1 * 1/2015 DePue ..... H02G 1/00 29/464

* cited by examiner

*Primary Examiner* — David B Thomas
(74) *Attorney, Agent, or Firm* — Howard Cohen

(57) ABSTRACT

The present application is directed towards bit holders. The bit holders include a main shaft, a sleeve, a collet and a spring.

15 Claims, 13 Drawing Sheets

BIT HOLDER

CROSS-REFERENCE TO RELATED APPLICATIONS

This application claims the benefit of priority of U.S. Provisional Application 61/686,825, filed Apr. 11, 2012, and U.S. Provisional Application 61/687,402, filed Apr. 23, 2012, the contents of which are incorporated herein by reference.

FIELD OF THE DISCLOSURE

The disclosure relates generally to the field of bit holders. More specifically, the present disclosure is directed to bit holders that secure screws.

BACKGROUND OF THE DISCLOSURE

There are several deficiencies present in typical screw bits, two of which are keeping the screw engaged with the bit while setting the screw (avoiding cam out) and starting the screw into a surface (maintaining bit-screw alignment). In many situations it is difficult for a user to use both hands at the correct angle to avoid these deficiencies.

Prior devices have attempted to avoid these deficiencies by providing a hollow, cylindrical sleeve with a magnet to magnetically hold the screw and align the screw along the sleeve. These devices have several deficiencies, the first being that the screw is mostly hidden from view, making, precise positioning difficult and makes the determination of the depth of the screw difficult to ascertain. Further, as down force is applied to the screw, the screw typically shifts to one side of the sleeve and is driven at an undesired angle. These prior devices also do not alleviate the issue of cam out.

What is desired is a bit holder that avoids cam out and can maintain a screw in an aligned position.

Embodiments of the present application provide a system that addresses the above and other issues.

SUMMARY OF THE DISCLOSURE

The present application is directed towards bit holders. The bit holders include a main shaft, a sleeve, a collet and a spring.

BRIEF DESCRIPTION OF THE DRAWINGS

The present disclosure will be better understood by reference to the following drawings of which.

DETAILED DESCRIPTION

Figure 1:
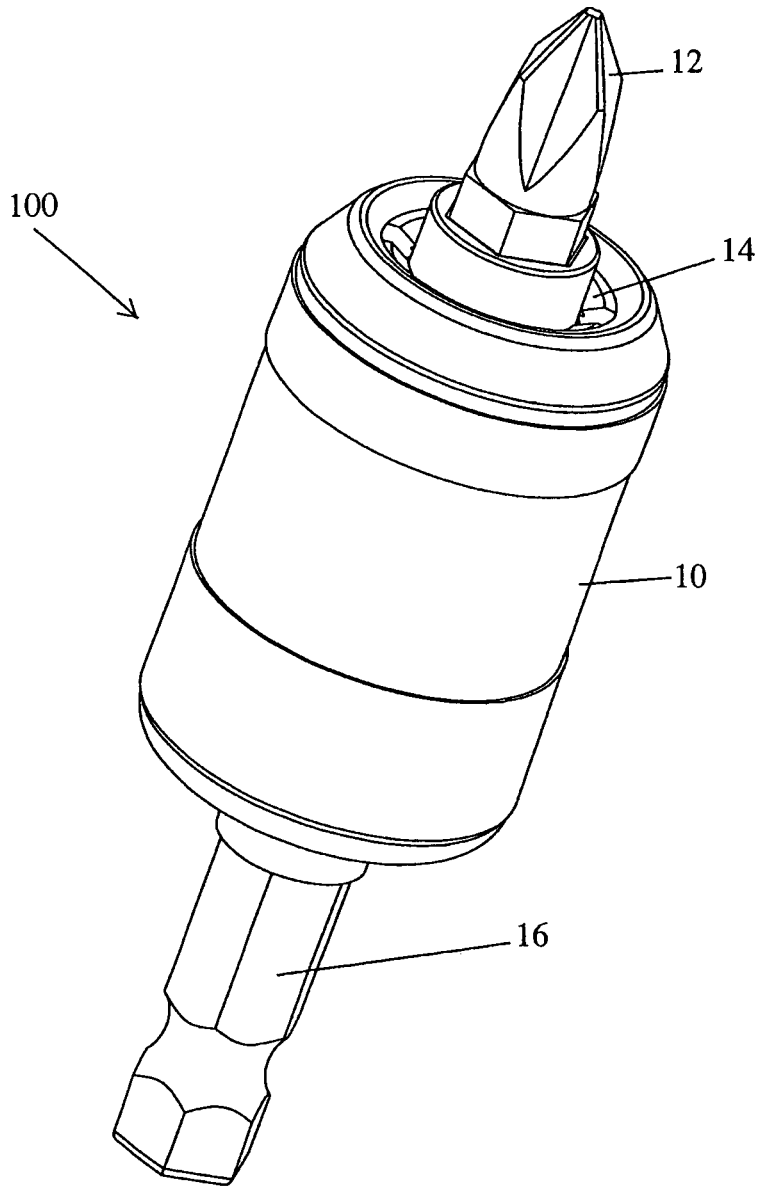
FIG. 1 is a perspective view of the first embodiment of the present disclosure.

The present application is directed towards bit holders. One embodiment of bit holder 100 is illustrated in FIG. 1, which is a general view of the exterior of bit holder 100. Bit holder 100 includes main shaft 16, sleeve 10, collet 14 and an optional bit 12 that is operably connected to the distal end of the main shaft 16. In this embodiment, bit 12 engaging with a screw 20 is shown as being a Philips head bit, but bit 12 can be a square bit, a hex bit, a slotted bit, a Frearson bit, a Torx bit, an X-shaped or cross-shaped bit, a T-shaped bit, a pentagon shaped bit, a hexalobular bin, a Bristol bit, a clutch bit, a line drive (ALR) bit, a spline bit, a spanner bit, a Torq-set bit, a TA bit, a TP# bit, a Tri-wing bit, or any combination thereof, or any other suitable bit. Further, the bit 12 can have one or more hollow portions or can be solid.

Figure 2:
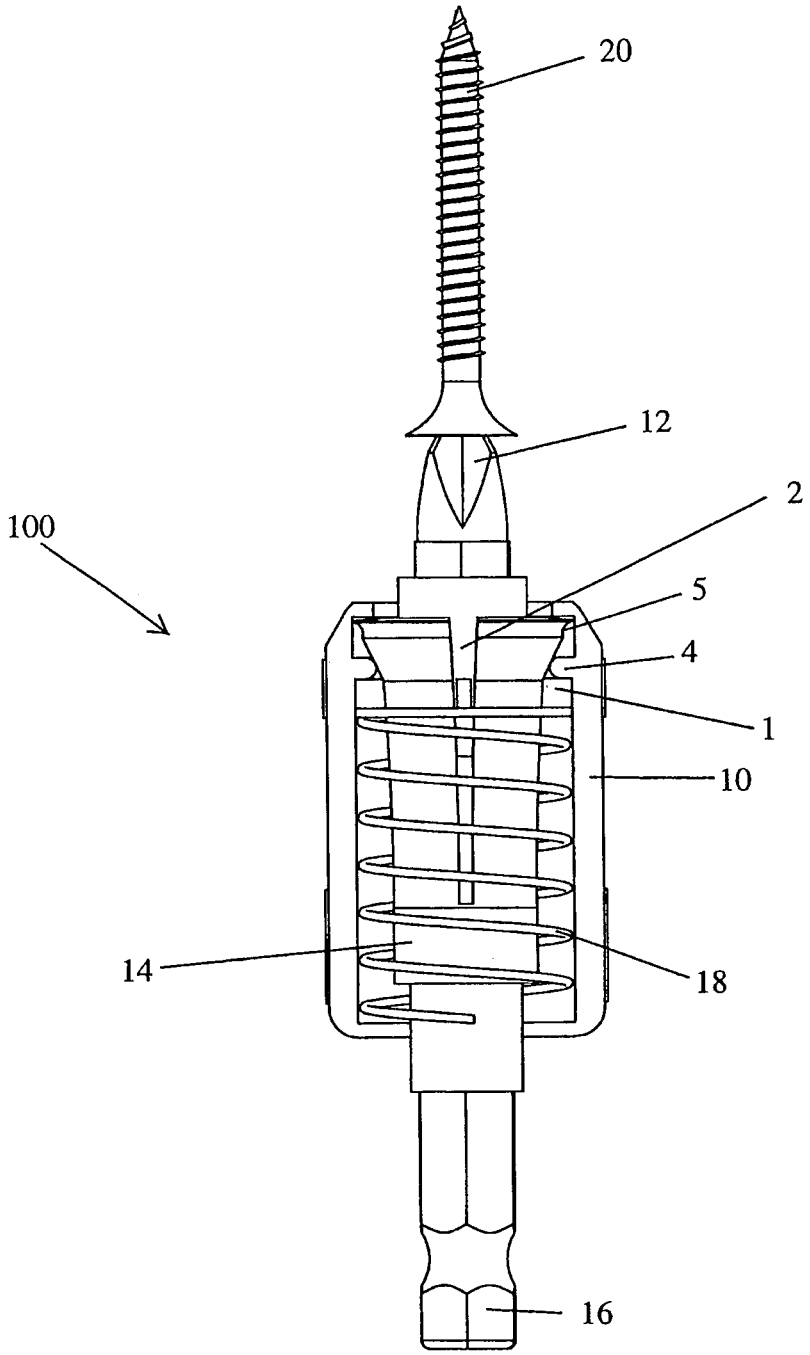
FIG. 2 is a perspective view of the first embodiment of the present disclosure, showing some components as semi-transparent.
Figure 3:
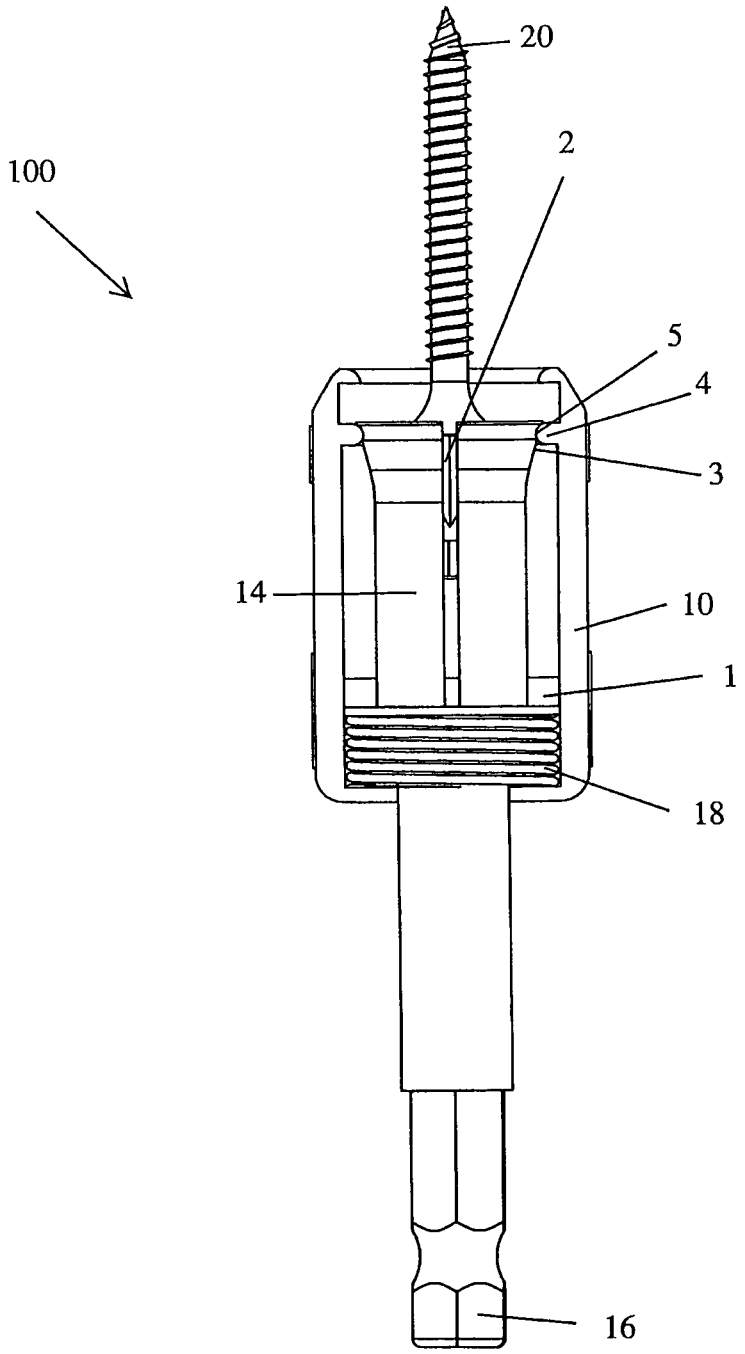
FIG. 3 is a perspective view of the first embodiment of the present disclosure, showing some components as semi-transparent.
Figure 4:
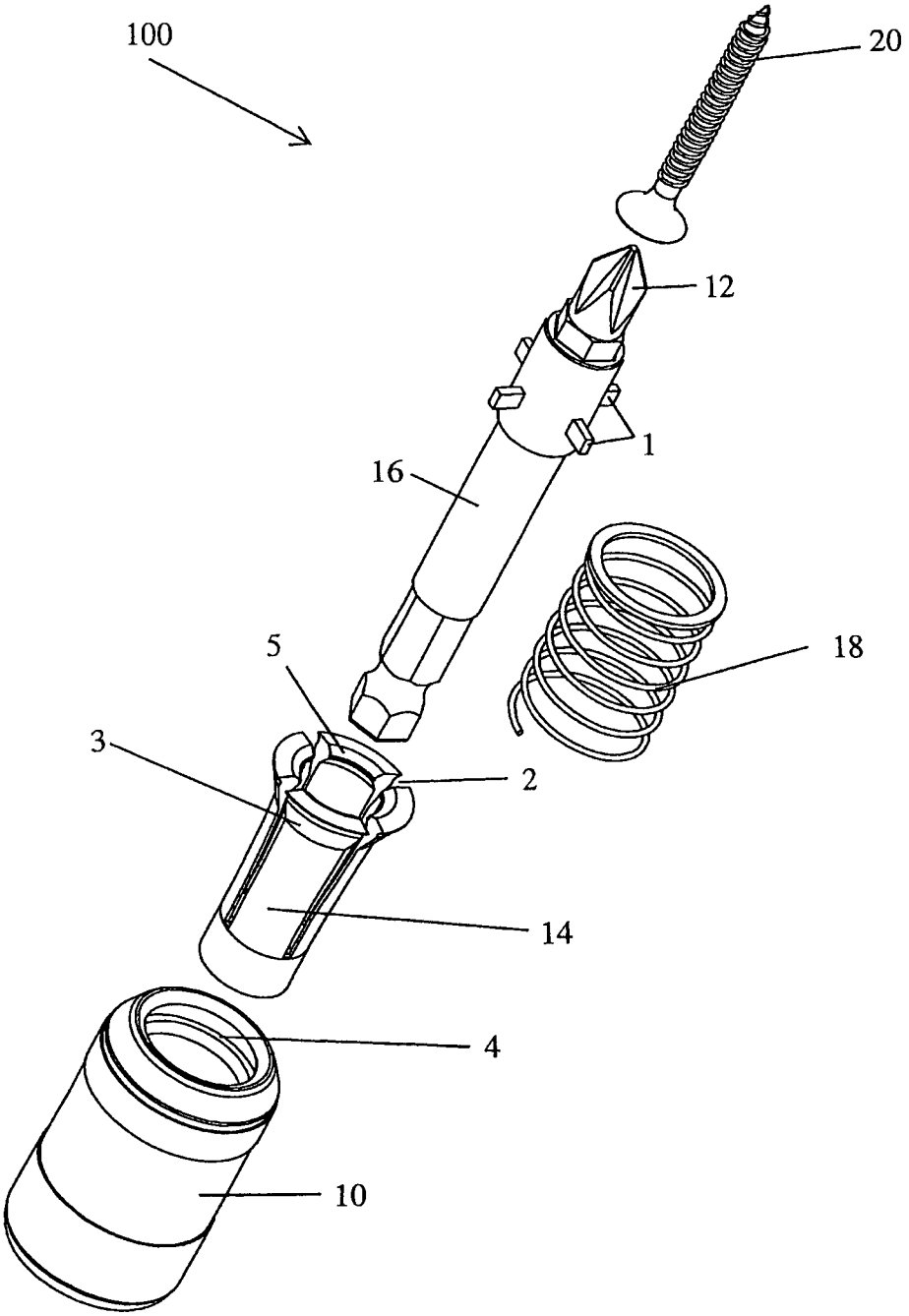
FIG. 4 is an exploded view of the first embodiment of the present disclosure, showing some components as semi-transparent.

As can be seen from FIGS. 2-4, which illustrate bit holder 100 in more detail, with some portions being shown as transparent, bit holder 100 also includes a spring 18. Elements indicated with the same reference number in each of the figures are intended to refer to the same elements.

Figure 5:
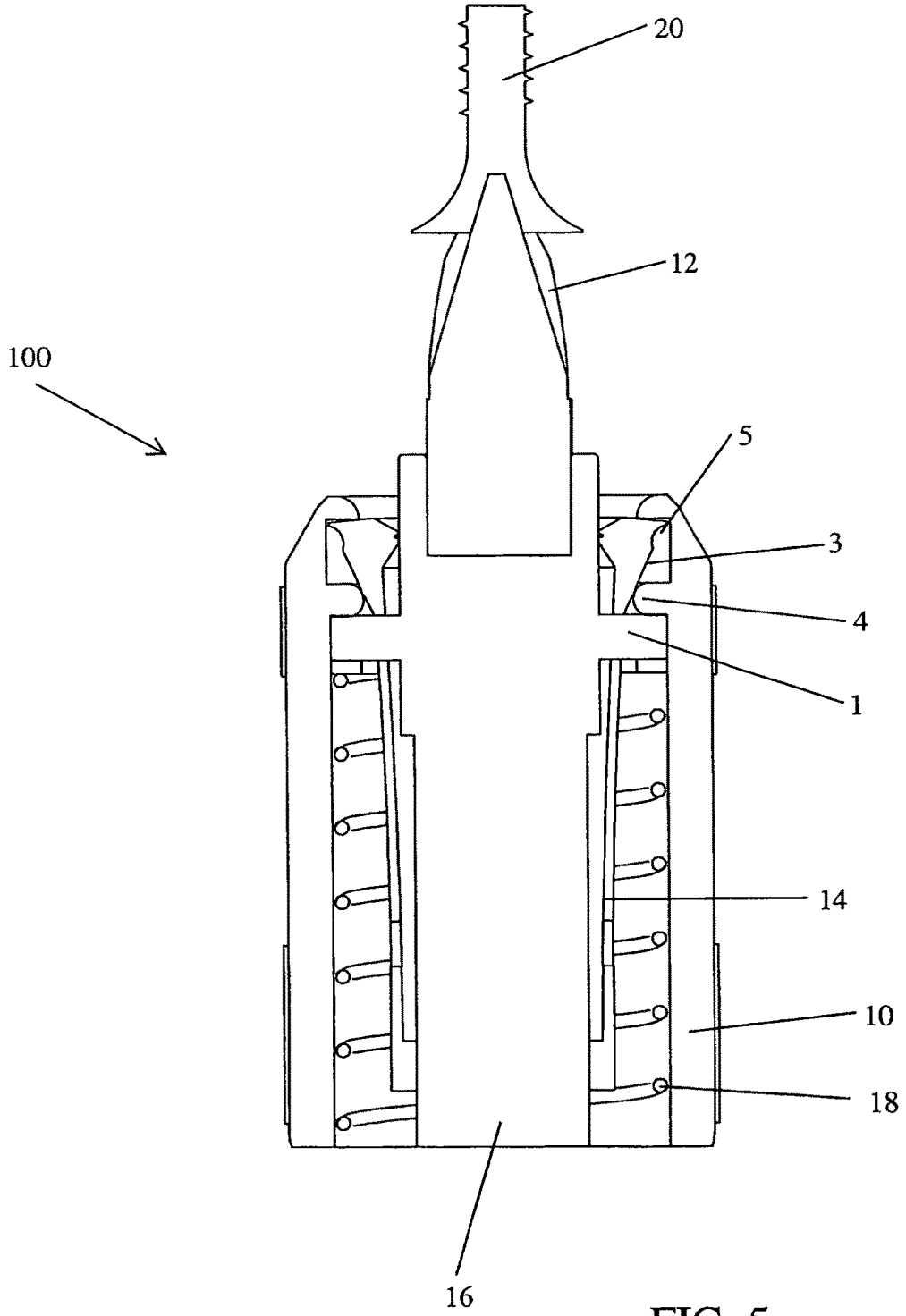
FIG. 5 is a perspective view of the first embodiment of the present disclosure, showing some components as semi-transparent.

In FIGS. 2-4, bit holder 100 includes main shaft 16, which includes one or more projections 1. As shown in FIG. 5, four projections 1 are shown, but one, two, three, five or more projections 1 could be used.

In FIGS. 2-4, bit holder 100 includes sleeve 10, which includes a protrusion 4 that extends radially along an interior face of the sleeve 10, at a distance away from the distal end of sleeve 10. Sleeve 10 extends around the circumference of main shaft 16 and extends along a predetermined distance along the axis of the main shaft 16. Depending on the specific use of the bit holder 100, the length of sleeve 10 can be modified to extend further or less far along the axis of the main shaft 16.

Collet 14 includes one or more slots 2. As shown in the figures, collet 14 includes four slots 2, but one, two, three, five or more slots 2 could be used. The slots 2 extend from the distal end of the collet 14 and end a distance away from the proximal end of the collet 14. The collet also includes a ramped interface 3 that begins at a distance away from the distal end of the collet 14 and ends at the distal end of the collet 14. As can be seen, the diameter at the distal end of collet 14 is increased by the ramped interface 3. The collet 14 also includes a groove 5 on the exterior face of the collet 14, a distance away from the distal end of the collet 14.

The collet 14 extends around the circumference of the main shaft 16 and extends along a predetermined distance along the axis of the main shaft 16. Depending on the specific use of the bit holder 100, the length of collet 14 can be modified to extend further or less far along the, axis of the main shaft 16.

Also included in bit holder 100 is spring 18. Spring 18 extends around the circumference of the main shaft 16 and extends along a predetermined distance along the axis of the main shaft 16. Depending on the specific use of the bit holder 100, the length of spring 18 can be modified to extend further or less far along the axis of the main shaft 16. Spring 8 is located between the sleeve 10 and the collet 14.

The projections 1 of the main shaft 16 are configured to travel along the slots 2 of collet 14 while the bit holder 100 is in use. The projections 1 of main shaft 16 extend a distance away from main shaft 16 and extend at least partially through slots 2 of collet 14. The projections 1 compress spring 18 against a proximal end of sleeve 10, as the sleeve is slid towards the distal end of main shaft 16. This compression of spring 18 to form a compressed state is seen in FIG. 3, while the decompression of spring 18 to form an expanded state is seen in FIG. 2.

To maintain spring 18 in the compressed state, groove 5 in collet 14 engages protrusion 4 of sleeve 10 and maintains the bit holder 100 in a compressed state.

Reference is now made to FIGS. 5-9 to describe the operation of bit holder 100.

Figure 6:
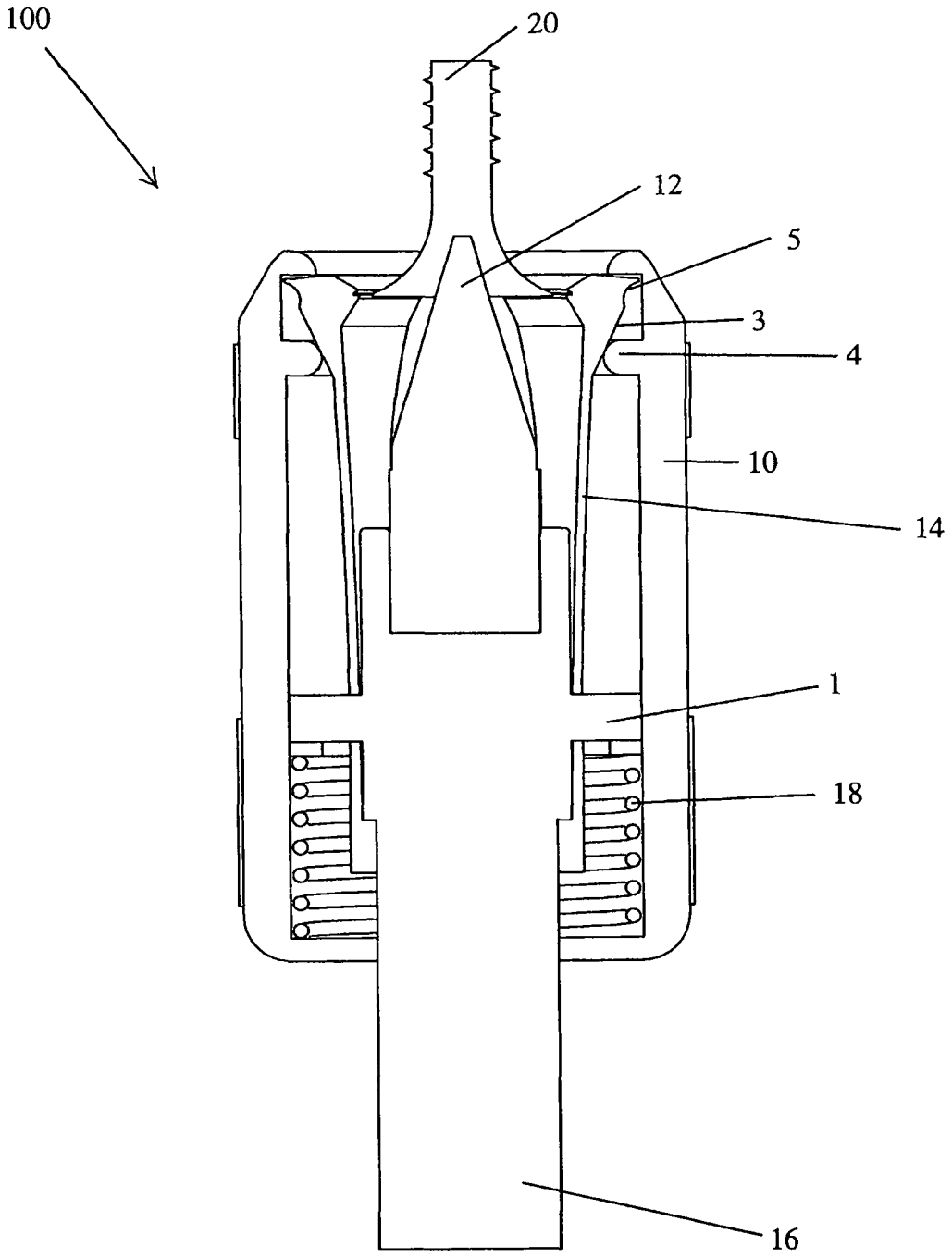
FIG. 6 is a perspective view of the first embodiment of the present disclosure, showing some components as semi-transparent.

Initially, screw 20 is placed onto bit 12, as shown in FIG. 5, before any compression of spring 18. Once screw 20 is placed onto bit 12, the user can either hold sleeve 10 steady while pressing down on screw 20, or hold screw 20 and slide sleeve 10 towards screw 20. As sleeve 10 slides toward the distal tip of bit 12, one or more projections 1, which are passing through the slots 2 of collet 14, contact spring 18 and begin to compress spring 18 towards the proximal end of sleeve 10, as shown in FIG. 6.

Figure 7:
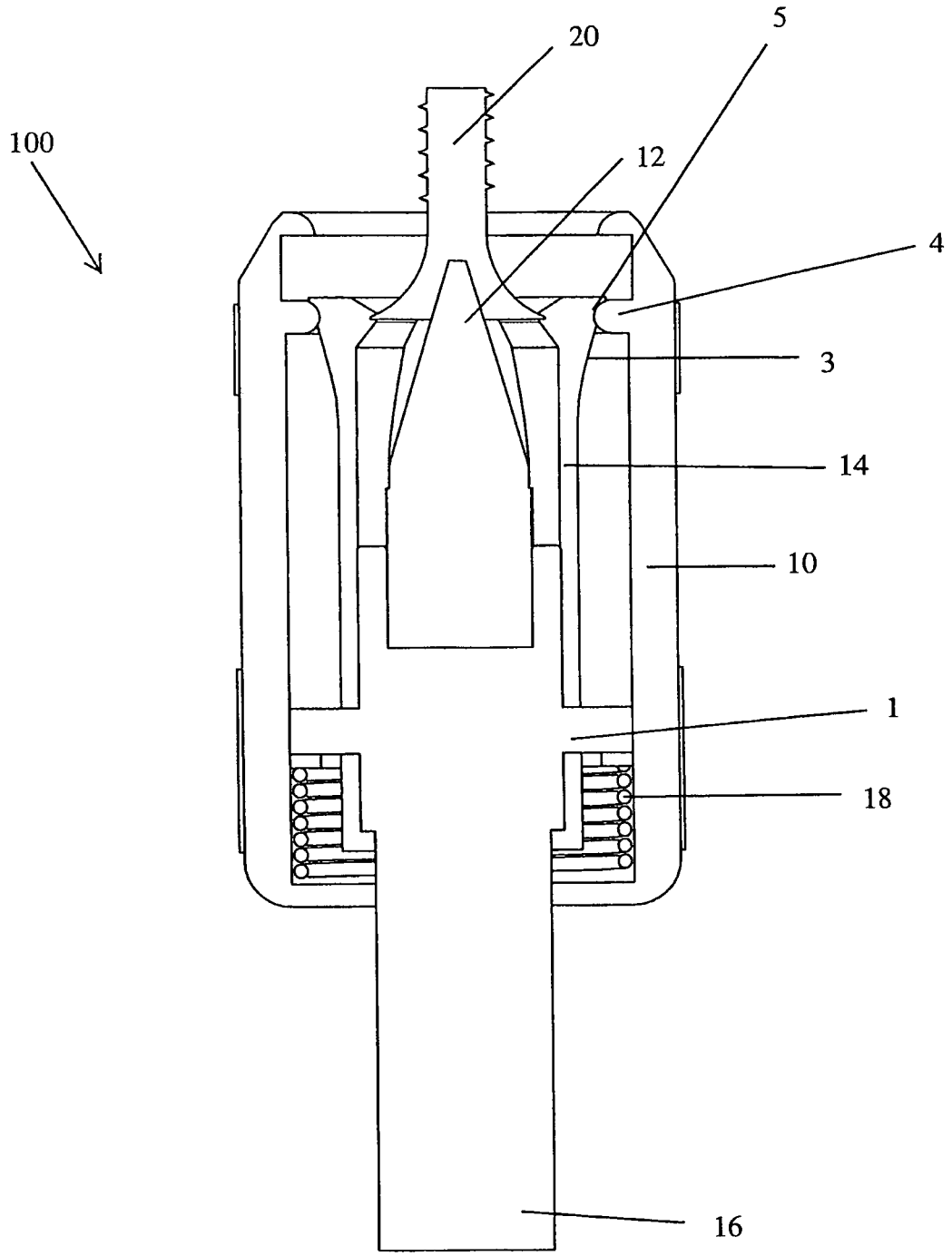
FIG. 7 is a perspective view of the first embodiment of the present disclosure, showing some components as semi-transparent.

As the sleeve 10 continues to move towards and past the distal tip of bit 12, the protrusion 4 of sleeve 10 slides along ramped interface 3 of collet 14. As protrusion 4 of sleeve 10 slides along ramped interface 3 of collet 14, the interior diameter of collet 14 is reduced. As sleeve 10 continues to move past the distal tip of bit 12, the protrusion 4 of sleeve 10 enters groove 5 of collet 14, which maintains spring 18 in a compressed state, as shown in FIG. 7. The interior face of collet 14, at a distance away from the distal end of collet 14, is now maintaining screw 20 in an aligned configuration by placing pressure around the circumference of the head of screw 20.

Figure 8:
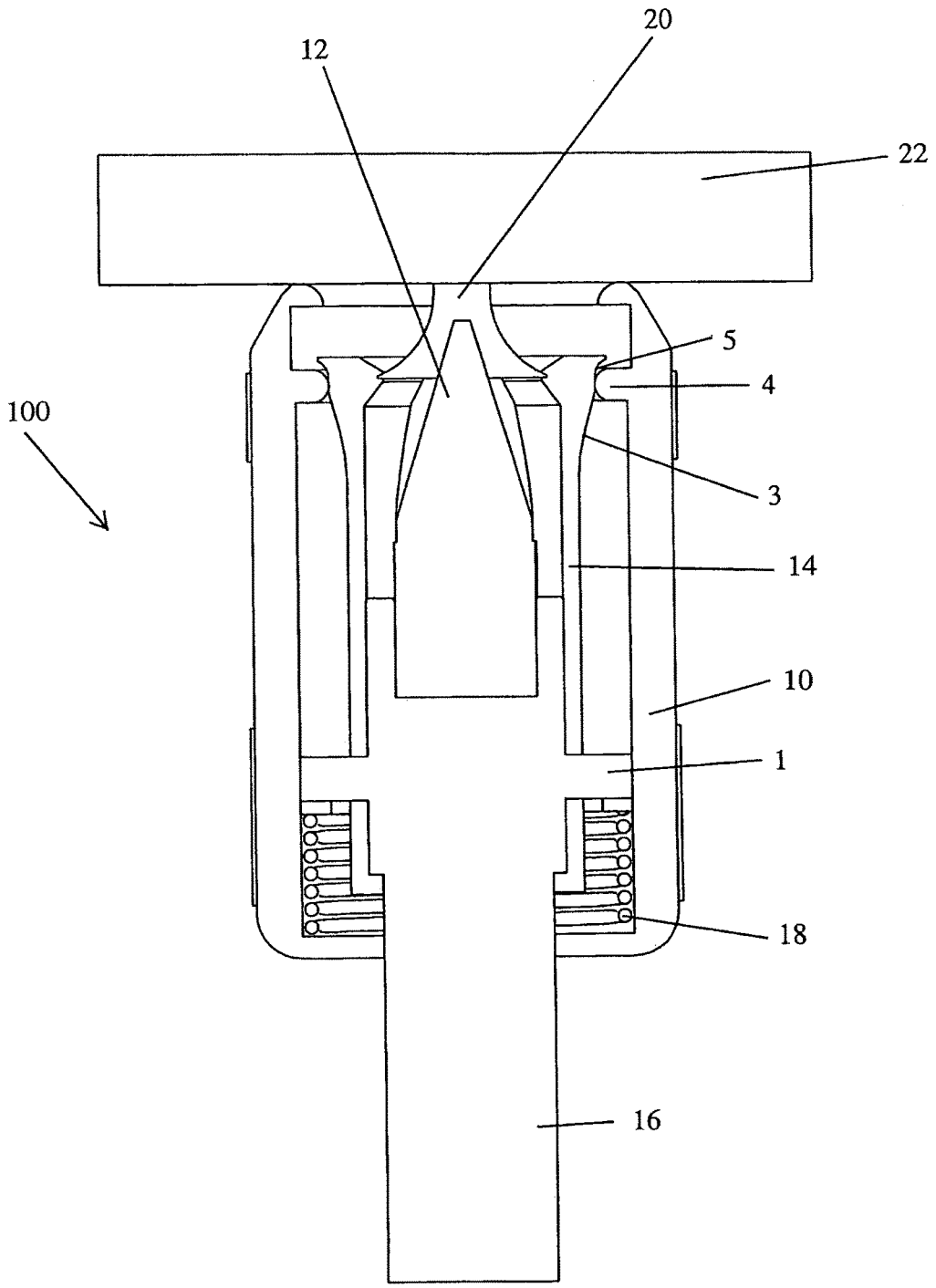
FIG. 8 is a perspective view of the first embodiment of the present disclosure, showing some components as semi-transparent.

Once screw 20 is secured by the collet 14, the screw 20 is rotated by the rotation of main shaft 16 and bit 12 into a material 22. As more of the screw 20 enters material 22, the distal end of sleeve 10 contacts the surface of material 22, as shown in FIG. 8. Once the distal end of sleeve 10 contacts the surface of material 22, and the screw 20 continues to be rotated, the protrusion 4 of sleeve 10 becomes disengaged from the groove 5 of collet 14.

Figure 9:
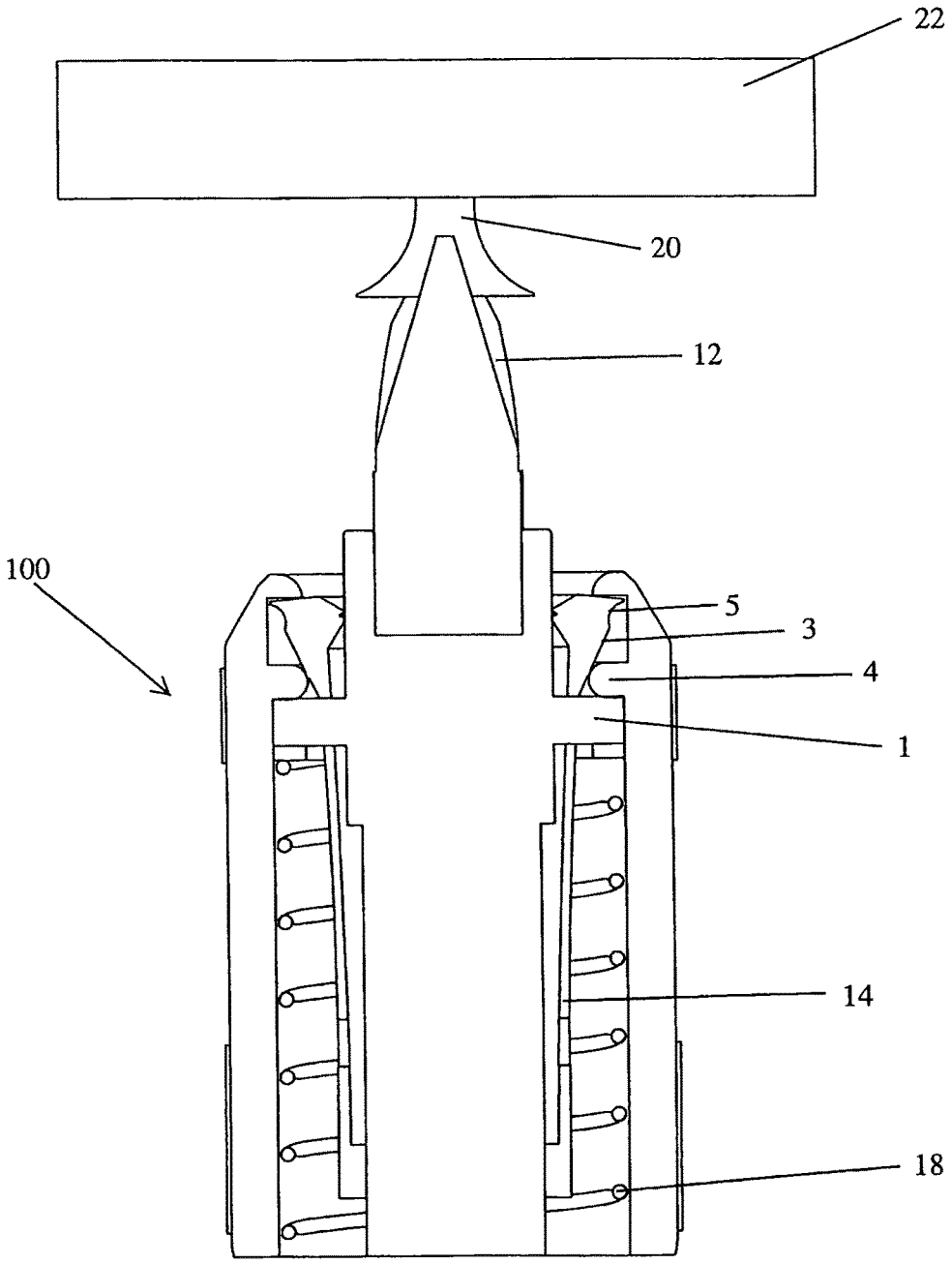
FIG. 9 is a perspective view of the first embodiment of the present disclosure, showing some components as semi-transparent.
Figure 10:
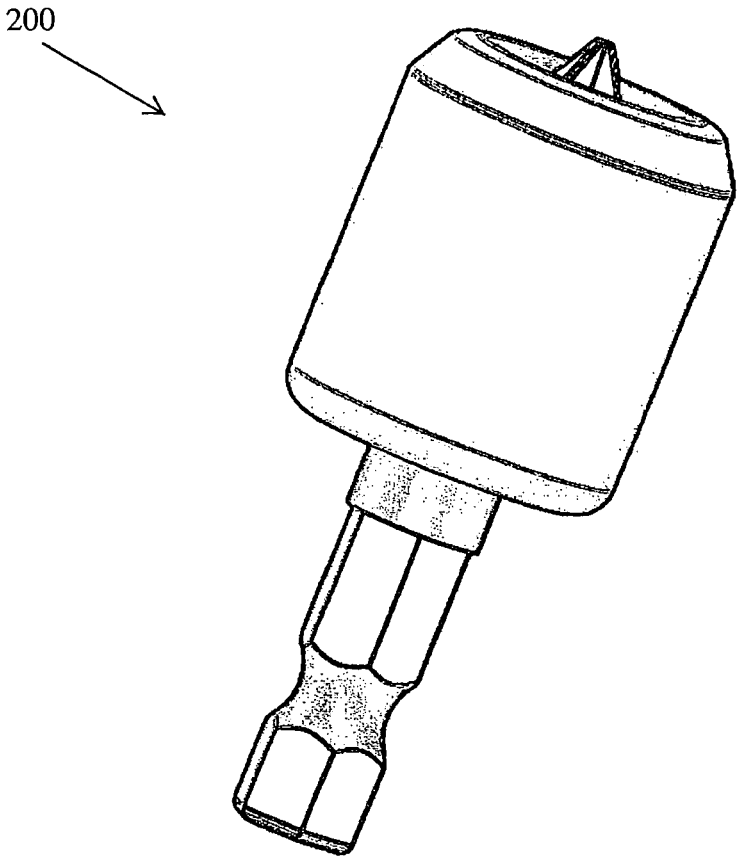
FIG. 10 is a perspective view of a second embodiment of the present disclosure.

Once the protrusion 4 of sleeve 10 is disengaged from the groove 5 of collet 14 the sleeve 10 is forced by spring 18 away from the distal end of bit 12, into an expanded state, as shown in FIG. 9. The remainder of screw 20 can now be rotated into material 22. As an alternative, a second embodiment of a bit holder 200 is shown in FIG. 10. In bit holder 200, the bit 12 can be of sufficient length so that once the protrusion 4 of sleeve 10 is disengaged from the groove 5 of collet 14 and the sleeve 10 is forced by spring 18 away from the distal end of bit 12, the head of screw 20 is flush with the surface of material 22. In this second embodiment of bit holder 200, the bit 12 extends a distance beyond the distal end of sleeve 10 while the spring 18 is in an expanded state.

Figure 11:
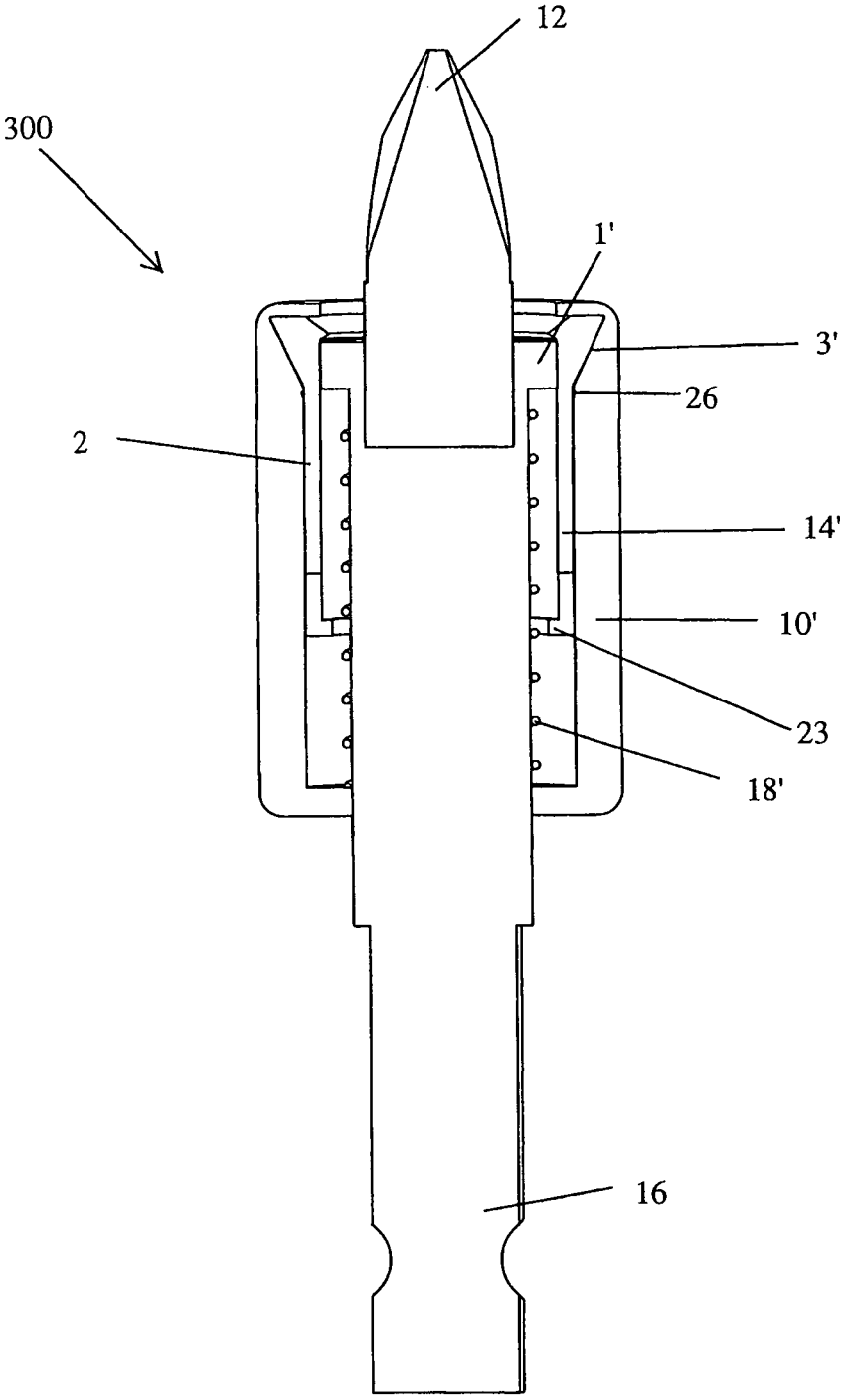
FIG. 11 is a perspective view of a third embodiment of the present disclosure, showing some components as semi-transparent.
Figure 12:
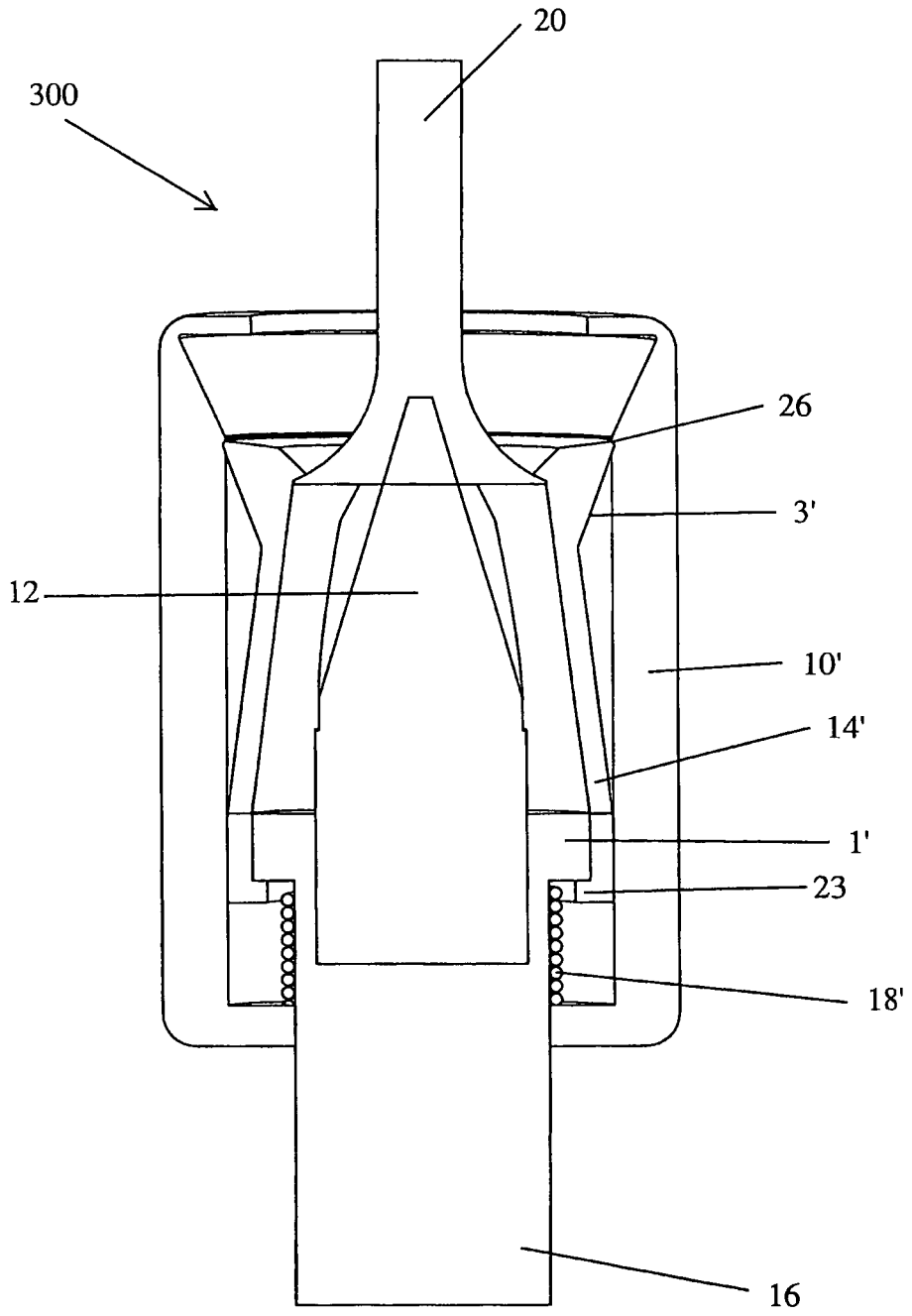
FIG. 12 is a perspective view of a third embodiment of the present disclosure, showing some components as semi-transparent.

In another alternative, a third embodiment 300 is shown in FIGS. 11 and 12. FIG. 11 illustrates third embodiment bit holder 300 in an expanded state and includes a main shaft 16, one or more projections 1' on the main shaft 16, an optional bit 12 that is operably connected to the distal end of the main shaft 16, a sleeve 10' comprising a groove 26 that extends radially along an interior face of sleeve 10' a distance away from the distal end of sleeve 10', with the sleeve 10' extending around the circumference of the main shaft 16 and extending a distance along the axis of main shaft 16. In this embodiment, optional bit 12 is shown as being a Philips head bit, but bit 12 can be a square bit, a hex bit, a slotted bit, a Frearson bit, a Torx bit, an X-shaped or cross-shaped bit, a T-shaped bit, a pentagon shaped bit, a hexalobular bin, a Bristol bit, a clutch bit, a line drive (ALR) bit, a spline bit, a spanner bit, a Torq-set bit, a TA bit, a TP# bit, a Tri-wing bit, or any combination thereof, or any other suitable bit. Further, the bit 12 can have one or more hollow portions or can be solid.

Third embodiment 300 also includes a collet 14' with the collet including one or more slots 2 that extend from a distal end of the collet 14' to a distance away from the proximal end of the collet 14'. Collet 14' includes a ramped interface 3' beginning a distance away from the distal end of the collet 14', the ramped interface 3' expanding an outer diameter of collet 14'. Collet 14' also includes an edge 23 a distance away from the proximal end of the collet 14', on an interior surface of the collet 14', with the edge extending around at least a portion of the circumference of the interior surface of the collet 14'. Collet 14' extends around the circumference of the main shaft 16 and extends a distance along the axis of the main shaft 16 between the main shaft 16 and a sleeve 10'. Third embodiment 300 also includes spring 18', which extends around the circumference of the main shaft 16 and extends a distance along the axis of the main shaft 16 between the main shaft 16 and the collet 14'. Depending on the specific use of the bit holder 300, the length of collet 14' can be modified to extend further or less far along the axis of the main shaft 16.

As the one or more projections 1' travel along the inside of collet 14', as the sleeve 10' is slid towards the distal end of main shaft 16, the one or more projections 1' compress spring 18' against a proximal end of sleeve 10'. As the sleeve 10' is slid further towards the distal end of main shaft 16, the one or more projections 1' then impact edge 23 impeding further movement of collet 14' in relation to sleeve 10'. To maintain spring 18' in a compressed state (as shown in FIG. 12), sleeve 10' is slid further towards the proximal end of main shaft 16 until groove 26 in sleeve 10' engages the peak of ramped interface 3'.

FIG. 12 illustrates third embodiment 300 in a compressed state. As shown in FIG. 12, bit 12 is below the distal end of sleeve 10' when bit holder 300 is in a compressed state, but in other embodiments, bit 12 can extend a distance beyond the distal end of sleeve 10' in the expanded state. Also shown in FIG. 12, a portion of the interior face of collet 14' is capable of accepting a head of a screw in an aligned configuration by placing pressure, around the circumference of the head of the screw 20.

The operation of bit holder 300 is similar to bit holder 100 described above. A user who secures a screw 20 as shown in FIG. 12 rotates the screw 20 into a material until the distal end of sleeve 10' impacts the surface of the material, causing the peak of the ramped interface 3' to exit groove 26, thereby allowing for sleeve 10' to slide away from the screw and return to a state as shown in FIG. 11.

Figure 13:
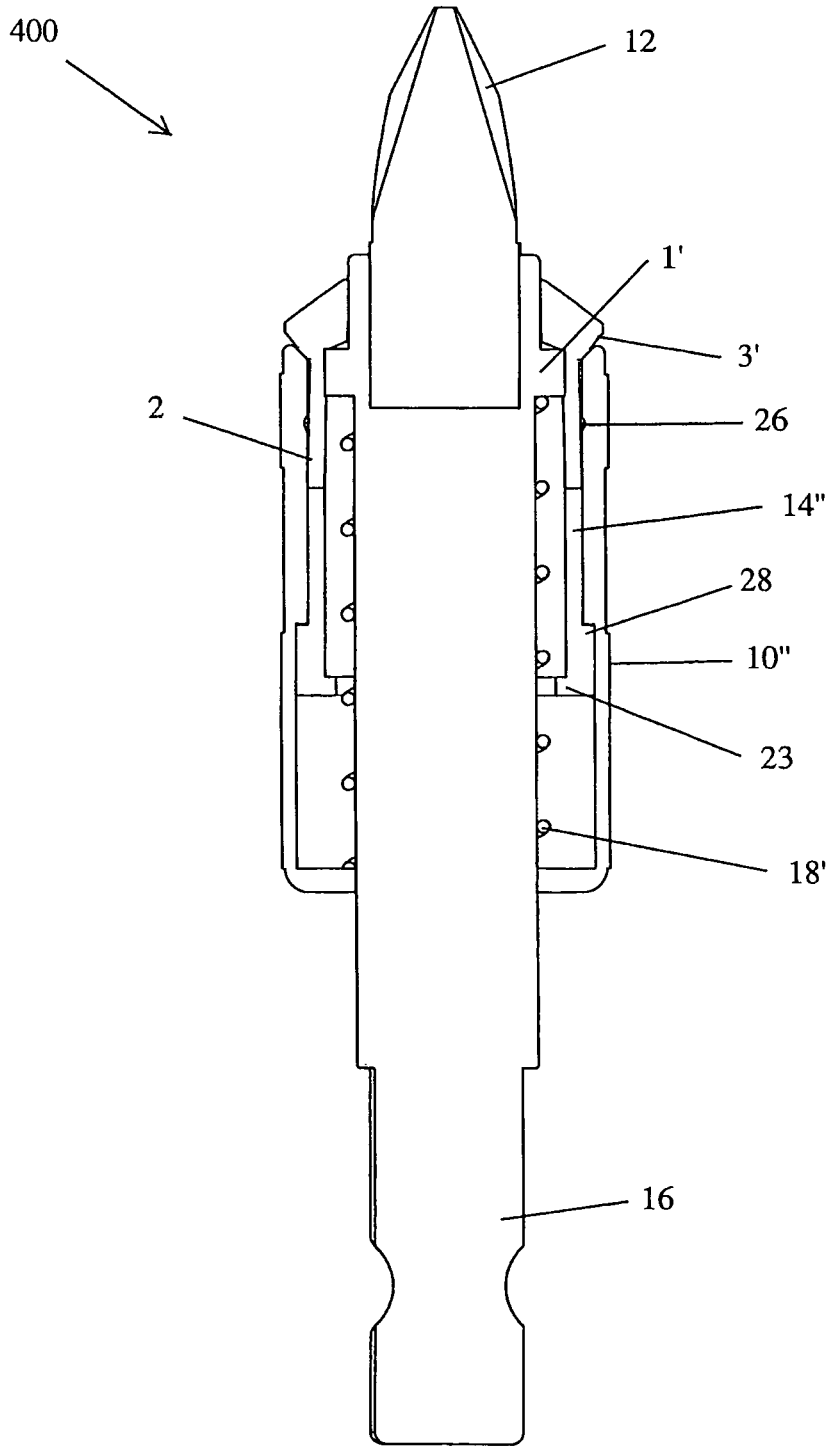
FIG. 13 is a perspective view of a fourth embodiment of the present disclosure, showing some components as semi-transparent.

An alternative embodiment of bit holder 300 is illustrated in FIG. 13 as bit holder 400. There are many similarities between bit holder 300 and bit holder 400 and they operate in a similar way. Bit holder 400 includes a collet 14" that extends beyond the distal end of sleeve 10" while bit holder 400 is in an expanded state. In operation of bit holder 400, the peak of ramped interface 3' enters groove 26 while the interior face of collet 14" secures a screw. During operation of bit holder 400, once sleeve 10" impacts a surface the screw is being driven into, the impact causes sleeve 10" to slide towards the proximal end of main shaft 16, which causes the peak of the ramped interface 3' to exit groove 26. As sleeve 10" continues to slide towards the proximal end of main shaft 16, the interior face of sleeve 10" impacts a distal edge 28 of collet 14" and causes collet 14" to slide towards the proximal end of main shaft 16, thereby allowing for sleeve 10" to slide away from the screw and return to a state as shown in FIG. 13.

As shown in FIGS. 11-13, two projections 1' are shown, but one, two, three, four, five or more projections I' could be used. As shown in the FIGS. 11-13, two slots slots 2 are shown, but one, three, four, five or more slots 2 could be used. One advantage of the embodiments shown in FIGS. 1-13 is that a user can see where the screw 20 is directed, and once a sleeve moves away from a bit during rotation of the screw, a line of sight can be maintained with the screw.

The described embodiments of the present disclosure are intended to be illustrative rather than restrictive, and are not intended to represent every embodiment of the present disclosure. Various modifications and variations can be made, including the addition and subtraction of features from one of the embodiments to the other, without departing from the spirit or scope of the disclosure as set forth in the following claims both literally and in equivalents recognized in law.

What is claimed is:

1. A bit holder comprising:

a main shaft, the main shaft comprising one or more projections;

a sleeve, the sleeve comprising a protrusion that extends radially along an interior face of the sleeve a distance away from the distal end of the sleeve, the sleeve extending around the circumference of the main shaft and extending a distance along the axis of the main shaft;

a collet, the collet comprising one or more slots extending from a distal end of the collet to a distance away from the proximal end of the collet and a ramped interface beginning a distance away from the distal end of the collet and ending at the distal end of the collet, the ramped interface expanding an outer diameter of the collet, the collet extending around the circumference of the main shaft and extending a distance along the axis of the main shaft between the main shaft and the sleeve;

and a spring extending around the circumference of the main shaft and extending a distance along the axis of the main shaft between the sleeve and the collet, wherein the one or more projections of the main shaft are configured to travel along the one or more slots of the collet, wherein the one or more projections of the main shaft extend away from the main shaft, through the one or more slots of the collet and compress the spring against a proximal end of the sleeve as the sleeve is slid towards the distal end of the main shaft, wherein a groove on the exterior face of the collet, a distance away from the distal end of the collet, is capable of engaging the protrusion and maintaining the spring in a compressed state.

2. The bit holder of claim 1, further comprising a bit operably connected to a distal end of the main shaft.

3. The bit holder of claim 2, wherein the bit is selected from the group consisting of a Phillips bit, a square bit, a hex bit, a slotted bit and a Frearson bit.

4. The bit holder of claim 2, wherein the bit extends a distance beyond the distal end of the sleeve in an expanded state.

5. The bit holder of claim 1, wherein a portion of the interior face of the collet a distance away from the distal end of the collet is capable of accepting a head of a screw.

6. A bit holder comprising:

a main shaft, the main shaft comprising one or more projections;

a sleeve, the sleeve comprising a groove that extends radially along an interior face of the sleeve a distance away from the distal end of the sleeve, the sleeve extending around the circumference of the main shaft and extending a distance along the axis of the main shaft;

a collet, the collet comprising one or more slots extending from a distal end of the collet to a distance away from the proximal end of the collet, a ramped interface beginning a distance away from the distal end of the collet and ending toward the distal end of the collet, the ramped interface expanding an outer diameter of the collet, and an edge a distance from a proximal end of the collet on an interior surface of the collet, the edge extending around at least a portion of the circumference of the interior surface of the collet, the collet extending around the circumference of the main shaft and extending a distance along the axis of the main shaft between the main shaft and the sleeve;

and a spring extending around the circumference of the main shaft and extending a distance along the axis of the main shaft between the main shaft and the collet, Wherein the one or more projections of the main shaft extend away from the main shaft and are configured to impact the edge, wherein the one or more projections of the main shaft compress the spring against a proximal end of the sleeve as the sleeve is slid towards the distal end of the main shaft, wherein the ramped interface is capable of engaging the groove and maintaining the spring in a compressed state.

7. The bit holder of claim 6, further comprising a bit operably connected to a distal end of the main shaft.

8. The bit holder of claim 7, wherein the bit is selected from the group consisting of a Phillips bit, a square bit, a hex bit, a slotted bit and a Frearson bit.

9. The bit holder of claim 7, wherein the bit extends a distance beyond the distal end of the sleeve in an expanded state.

10. The bit holder of claim 6, wherein a portion of the interior face of the collet a distance away from the distal end of the collet is capable of accepting a head of a screw.

11. A method of rotating a screw into a material, the method comprising the steps of:

a. placing a screw onto a bit of a bit holder, the bit operably connected to a main shaft;

b. moving a sleeve of the bit holder, in relation to a collet, towards a distal end of the bit, the sleeve extending around the circumference of the main shaft and extending a distance along the axis of the main shaft, the collet comprising one or more slots extending from a distal end of the collet to a distance away from the proximal end of the collet, and a ramped interface beginning a distance away from the distal end of the collet and ending toward the distal end of the collet, the ramped interface expanding an outer diameter of the collet, the collet extending around the circumference of the main shaft and extending a distance along the axis of the main shaft between the main shaft and the sleeve;

c. compressing a spring, the spring extending around the circumference of the main shaft and extending a distance along the axis of the main shaft between the main shaft and the collet, d. engaging a portion of the ramped interface with a portion of the sleeve, thereby securing the screw against an interior face of the collet e. rotating the bit;

f. contacting a portion of the bit holder to a surface of the material; and g. disengaging the portion of the ramped interface from the portion of the sleeve so that the spring expands and causes the sleeve to move away from the distal end of the bit.

12. The method of claim 11, wherein the portion of the bit holder is the sleeve.

13. The method of claim 11, wherein the portion of the ramped interface is the peak of the ramped interface and the portion of the sleeve is a groove, and the peak of the ramped interface engages the groove to secure the screw against an interior face of the collet.

14. The method of claim 11, wherein the portion of the ramped interface is a groove and the portion of the sleeve is a protrusion, and the protrusion engages the groove to secure the screw against an interior face of the collet.

15. The method of claim 11, further comprising an edge of the collet a distance from a proximal end of the collet on an exterior surface of the collet, the edge extending around at least a portion of the circumference of the exterior surface of the collet, wherein as the sleeve moves away from the distal end of the bit, a portion of the sleeve contacts the edge, causing the collet to move away from the distal end of the bit.

* * * * *